US007801456B2

(12) United States Patent
Otsuka

(10) Patent No.: US 7,801,456 B2
(45) Date of Patent: Sep. 21, 2010

(54) IMAGE FORMING APPARATUS

(75) Inventor: Yutaka Otsuka, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/098,102

(22) Filed: Apr. 4, 2008

(65) Prior Publication Data

US 2008/0187340 A1 Aug. 7, 2008

Related U.S. Application Data

(62) Division of application No. 10/977,012, filed on Nov. 1, 2004, now Pat. No. 7,369,787.

(30) Foreign Application Priority Data

May 31, 2004 (JP) ..... 2004-161365

(51) Int. Cl.
*G03G 15/20* (2006.01)
*G03G 15/00* (2006.01)

(52) U.S. Cl. ..... 399/68; 399/69; 399/406

(58) Field of Classification Search ..... 399/69, 399/68, 406

See application file for complete search history.

(56) References Cited

U.S. PATENT DOCUMENTS

| | | | | |
|---|---|---|---|---|
| 5,875,373 | A | 2/1999 | Sato et al. | |
| 6,816,686 | B2 * | 11/2004 | Hooper et al. | 399/44 |
| 2003/0002881 | A1 | 1/2003 | Hirose et al. | |
| 2003/0103789 | A1 | 6/2003 | Boss | |
| 2003/0156176 | A1 | 8/2003 | Miyamoto et al. | |
| 2004/0131374 | A1 | 7/2004 | Sakai | |
| 2004/0202491 | A1 | 10/2004 | Sakai et al. | |
| 2004/0239749 | A1 | 12/2004 | Kagawa et al. | |
| 2004/0264992 | A1 | 12/2004 | Shiraishi | |

FOREIGN PATENT DOCUMENTS

JP 61-190562 11/1986

(Continued)

OTHER PUBLICATIONS

Otsuka, Y., U.S. Office Action mailed on May 18, 2006, directed to U.S. Appl. No. 10/977,012; 12 pages.

(Continued)

*Primary Examiner*—David M Gray
*Assistant Examiner*—Erika Villaluna
(74) *Attorney, Agent, or Firm*—Morrison & Foerster LLP

(57) ABSTRACT

An image forming apparatus has a heating rotator 12 that is heated by a first heat source 18, a pressurizing rotator 24 that is heated by a second heat source 28, that is in pressure contact with the heating rotator 12, and that forms a fixing nip 26 between the pressurizing rotator 24 and the heating rotator 12, a temperature sensor St that detects a temperature in the apparatus, and a controller 124 that controls temperatures of the heating rotator 12 and of the pressurizing rotator 24 by on-off control over the first heat source 18 and the second heat source 28, respectively, and that sets the temperature of the pressurizing rotator 24 higher than a normal temperature on condition that the temperature detected by the temperature sensor St exceeds a specified value.

9 Claims, 5 Drawing Sheets

FOREIGN PATENT DOCUMENTS

| | | | |
|---|---|---|---|
| JP | 5-224480 | | 9/1993 |
| JP | 06003915 | A * | 1/1994 |
| JP | 9-34302 | | 2/1997 |
| JP | 9-114318 | | 5/1997 |
| JP | 2000-181277 | | 3/2000 |
| JP | 2000-162920 | | 6/2000 |
| JP | 2003-302861 | | 10/2003 |
| JP | 2004-151474 | | 5/2004 |

OTHER PUBLICATIONS

Otsuka, Y., U.S. Office Action mailed on Nov. 2, 2006, directed to U.S. Appl. No. 10/977,012; 13 pages.
Otsuka, Y., U.S. Office Action mailed on Aug. 13, 2007, directed to U.S. Appl. No. 10/977,012; 6 pages.

* cited by examiner

IMAGE FORMING APPARATUS

RELATED APPLICATIONS

This application is a divisional of U.S. patent application Ser. No. 10/977,012, filed Nov. 1, 2004, now U.S. Pat. No. 7,369,787, issued May 6, 2008, which is based on Japanese Patent Application No. 2004-161365, filed May 31, 2004, the entire contents of which are incorporated herein by reference.

BACKGROUND OF THE INVENTION

The present invention relates to an image forming apparatus in a copying machine, a printer, a facsimile, a compound machine of those or the like.

In conventional image forming apparatus of electrographic type, a paper sheet having an unfixed toner image formed on a surface thereof is passed through a fixing device, and the toner image is thereby heated and fused to be fixed on the sheet, which is thereafter ejected from the image forming apparatus and is stacked and stored on an ejected-paper tray.

When the sheet is passed through the fixing device, curl is given to the sheet by influence of heat transferred to the sheet. An increase in amount of the curl deteriorates condition of the stacking, when a large number of sheets are stacked and stored on the ejected-paper tray, and thus may make it impossible to store a number of sheets that can be stacked and stored on condition that the amount of the curl is small.

It has been known that an amount of curl of a paper sheet can be reduced by decrease in fixation temperature on occasion of thermal fixation for the sheet. In an image forming apparatus disclosed in Japanese Laying-Open Publication No. 2000-162920, for solution of the problem of deterioration in stacking ability, a fixation temperature is controlled to be set lower than normal one when a number of ejected sheets reaches a specified number such that influence of the curl on sheet stacking ability on an ejected-paper tray appears.

The decrease in the fixation temperature of a fixing device as in the image forming apparatus disclosed in the publication, however, causes another problem of deterioration in image fixation performance.

SUMMARY OF THE INVENTION

An object of the present invention is to provide an image forming apparatus that is capable of reducing deterioration in sheet stacking ability on an ejected-paper tray by restraining amounts of curl of paper sheets while maintaining a fixation performance.

In order to achieve the object, in accordance with a first aspect of the invention, there is provided an image forming apparatus comprising:

a heating rotator that is heated by a first heat source;

a pressurizing rotator that is heated by a second heat source, that is in pressure contact with the heating rotator, and that forms a fixing nip between the pressurizing rotator and the heating rotator;

a temperature sensor that detects a temperature in the apparatus; and a controller that controls temperatures of the heating rotator and of the pressurizing rotator by on-off control over the first heat source and the second heat source, respectively, and that sets the temperature of the pressurizing rotator higher than a normal temperature on condition that the temperature detected by the temperature sensor exceeds a specified value.

In the image forming apparatus in accordance with the first aspect of the invention, the controller may carry out control for decreasing the temperature of the heating rotator simultaneously when increasing the temperature of the pressurizing rotator on condition that the temperature detected by the temperature sensor exceeds a specified value.

In the image forming apparatus in accordance with the first aspect of the invention, the controller may be capable of adjusting intervals between paper sheets that are continually passed through the fixing nip, and may carry out control for increasing the intervals between the paper sheets when increasing the temperature of the pressurizing rotator.

In the image forming apparatus in accordance with the first aspect of the invention, the apparatus may further comprise a humidity sensor for detecting a relative humidity in the apparatus, and the controller may carry out control for making the temperature of the pressurizing rotator higher than the normal temperature on condition that an absolute humidity calculated from the temperature detected by the temperature sensor and from the relative humidity detected by the humidity sensor exceeds a specified value.

In the image forming apparatus in accordance with the first aspect of the invention, the controller may carry out control to normally keep the temperature of the heating rotator higher than the temperature of the pressurizing rotator.

In accordance with a second aspect of the invention, there is provided an image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a temperature sensor that detects a temperature in the apparatus;

a humidity sensor that detects a relative humidity in the apparatus;

a calculator for calculating an absolute humidity from the temperature detected by the temperature sensor and from the relative humidity detected by the humidity sensor; and a controller that controls temperatures of the heating rotator and of the pressurizing rotator by on-off control over the first heat source and the second heat source, respectively, and that sets the temperature of the pressurizing rotator higher than a normal temperature on condition that the absolute humidity calculated by the calculator exceeds a specified value.

In the image forming apparatus in accordance with the second aspect of the invention, the controller may carry out control for decreasing the temperature of the heating rotator simultaneously when increasing the temperature of the pressurizing rotator on condition that the temperature detected by the temperature sensor exceeds a specified value.

In the image forming apparatus in accordance with the second aspect of the invention, the controller may be capable of adjusting intervals between paper sheets that are continually passed through the fixing nip, and may carry out control for making the intervals between the paper sheets larger than a normal value when increasing the temperature of the pressurizing rotator.

In the image forming apparatus in accordance with the second aspect of the invention, the controller may carry out control to normally keep the temperature of the heating rotator higher than the temperature of the pressurizing rotator.

In accordance with a third aspect of the invention, there is provided an image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator; and a controller that controls temperatures of the heating rotator and of the pressurizing rotator by on-off control over the first heat source and the second heat source, respectively, and that sets the temperature of the pressurizing rotator higher than that for regular paper when a basis weight of a paper sheet passing through the fixing nip is smaller than that of regular paper.

In the image forming apparatus in accordance with the third aspect of the invention, the controller may further have a temperature sensor for detecting a temperature in the apparatus, and the controller may carry out control for decreasing the temperature of the heating rotator simultaneously when increasing the temperature of the pressurizing rotator on condition that the temperature detected by the temperature sensor exceeds a specified value.

In the image forming apparatus in accordance with the third aspect of the invention, the controller may be capable of adjusting intervals between paper sheets that are continually passed through the fixing nip, and the controller may carry out control for making the intervals between the paper sheets larger than a normal value when increasing the temperature of the pressurizing rotator.

In the image forming apparatus in accordance with the third aspect of the invention, the apparatus may further have an operation panel for selecting a type of the paper sheet, and the controller may change the temperature of the pressurizing rotator in accordance with a result of the selection of the paper sheet on the operation panel.

In accordance with a fourth aspect of the invention, there is provided an image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a sensor that detects an amount of curl of a paper sheet that has been passed through the fixing nip; and a controller that controls temperatures of the heating rotator and of the pressurizing rotator by on-off control over the first heat source and the second heat source, respectively, and that sets the temperature of the pressurizing rotator higher than a normal temperature on condition that the amount of curl detected by the sensor exceeds a specified value.

In the image forming apparatus in accordance with the fourth aspect of the invention, the controller may carry out control for decreasing the temperature of the heating rotator simultaneously when increasing the temperature of the pressurizing rotator on condition that the amount of curl detected by the sensor exceeds a specified value.

In the image forming apparatus in accordance with the fourth aspect of the invention, the controller may be capable of adjusting intervals between paper sheets that are continually passed through the fixing nip, and the controller may carry out control for making the intervals between the paper sheets larger than a normal value when increasing the temperature of the pressurizing rotator.

In accordance with a fifth aspect of the invention, there is provided an image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a temperature sensor that detects a temperature in the apparatus; and a controller that increases intervals between paper sheets being continually passed through the fixing nip so that the intervals may be larger than a normal value on condition that the temperature detected by the temperature sensor exceeds a specified value.

In the image forming apparatus in accordance with the fifth aspect of the invention, the controller may carry out control for increasing a temperature of the pressurizing rotator on condition that the temperature detected by the temperature sensor exceeds a specified value.

In the image forming apparatus in accordance with the fifth aspect of the invention, the controller may carry out control for decreasing a temperature of the heating rotator simultaneously when increasing a temperature of the pressurizing rotator on condition that the temperature detected by the temperature sensor exceeds a specified value.

In accordance with a sixth aspect of the invention, there is provided an image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a humidity sensor that detects a humidity in the apparatus; and a controller that increases intervals between paper sheets being continually passed through the fixing nip so that the intervals may be larger than a normal value on condition that a humidity obtained on basis of output from the humidity sensor exceeds a specified value.

In the image forming apparatus in accordance with the sixth aspect of the invention, the controller may carry out control for increasing a temperature of the pressurizing rotator on condition that a humidity obtained on basis of output from the humidity sensor exceeds a specified value.

In the image forming apparatus in accordance with the sixth aspect of the invention, the controller may carry out control for decreasing a temperature of the heating rotator simultaneously when increasing a temperature of the pressurizing rotator on condition that a humidity obtained on basis of output from the humidity sensor exceeds a specified value.

In accordance with the image forming apparatus of the invention, the temperature of the pressurizing rotator is set higher than a normal temperature when it is judged, e.g., on basis of temperature, humidity, type of paper sheets, or amount of curl of paper sheets that the amounts of curl of paper sheets will increase. Thus the amounts of curl of the paper sheets can be reduced by decrease in temperature difference between the heating rotator and the pressurizing rotator while the image fixation performance is maintained. As a result, deterioration in the sheet stacking ability on the ejected-paper tray can be reduced.

The control for decreasing the temperature of the heating rotator to such a extent that no influence is exerted upon the fixation performance, simultaneous with the control for increasing the temperature of the pressurizing rotator, further decreases the temperature difference between the heating rotator and the pressurizing rotator and therefore makes the effect of reducing the deterioration in the sheet stacking ability more remarkable.

Provided that the intervals between the paper sheets are made larger than normal intervals when the temperature of the pressurizing rotator is increased, an amount of heat taken from the pressurizing rotator into the paper sheets is decreased and a length of time during which the pressurizing rotator is in contact with the heating rotator is increased so that an amount of heat transferred from the heating rotator to the pressurizing rotator is increased, in comparison with the operation with the normal sheet intervals. Accordingly, recovery of the temperature of the pressurizing rotator on occasion of the continual sheet feeding is quickened. Thus a number of paper sheets having large amounts of curl can be decreased because a length of time during which the temperature of the pressurizing rotator is low is decreased and because the increase in the sheet intervals causes decrease in a number of sheets that are fed per unit time. As a result, the effect of reducing the deterioration in the sheet stacking ability becomes further remarkable.

Provided that the intervals between the paper sheets are made larger than the normal intervals on condition that the temperature or the humidity exceeds each specified value, an amount of heat taken from the pressurizing rotator into the paper sheets is decreased and a length of time during which the pressurizing rotator is in contact with the heating rotator is increased so that an amount of heat transferred from the heating rotator to the pressurizing rotator is increased, in comparison with the operation with the normal sheet intervals. Accordingly, recovery of the temperature of the pressurizing rotator on occasion of the continual sheet feeding is quickened. Thus a number of paper sheets having large amounts of curl can be decreased because a length of time during which the temperature of the pressurizing rotator is low is decreased and because the increase in the sheet intervals causes decrease in a number of sheets that are fed per unit time. As a result, the deterioration in the sheet stacking ability can be reduced.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
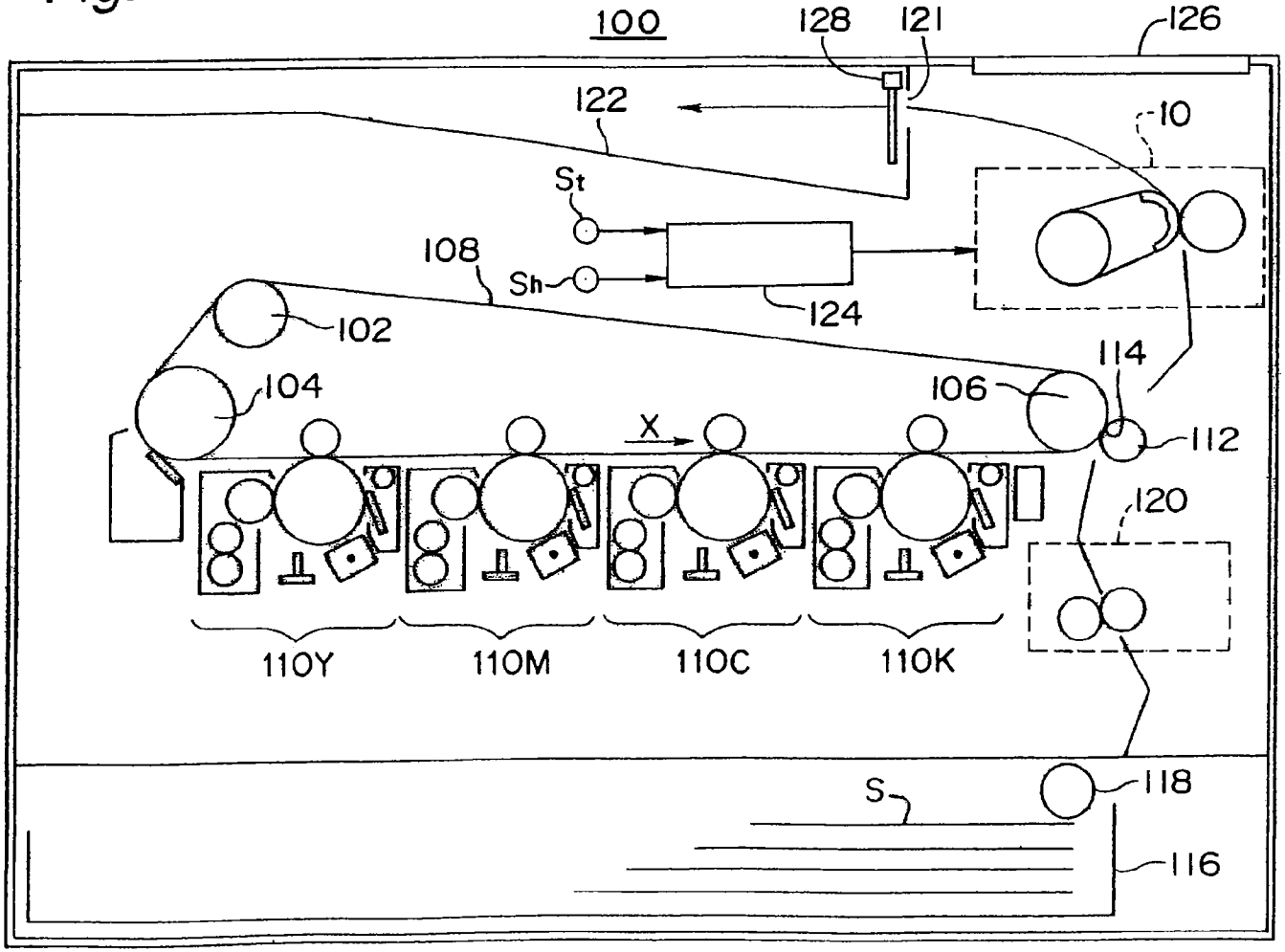
FIG. 1 is a diagram showing a general configuration of an image forming apparatus.

FIG. 1 is a schematic diagram of an image forming apparatus 100 that is an embodiment of the invention. The image forming apparatus 100 has an intermediate transfer belt 108 that is supported by three rollers 102, 104, and 106 and that is driven to rotate in a direction of an arrow X.

Under the intermediate transfer belt 108 are aligned image forming units 110Y, 110M, 100C, and 110K corresponding to yellow (Y), magenta (M), cyan (C), and black (K) toner. Toner images with the four colors can be formed and superposed on the intermediate transfer belt 108 by the image forming units 110Y, 110M, 110C, and 110K.

A transfer roller 112 is placed so as to be in contact with part of the intermediate transfer belt 108 that is supported by the roller 106. A transfer region 114 is formed between the transfer roller 112 and the intermediate transfer belt 108.

In a lower section of the image forming apparatus 100 is provided a paper feeding cassette 116 containing paper sheets S. The paper sheets S stacked and stored in the paper feeding cassette 116 are fed one by one, by a paper feeding roller 118.

A paper sheet S forwarded from the paper feeding cassette 116 is conveyed in a generally vertical direction by a sheet conveying unit 120 or the like. In process of the conveyance, toner images are transferred from the intermediate transfer belt 108 onto the paper sheet S when the paper sheet S passes through the transfer region 114, the toner images are thereafter fixed on the paper sheet S when the paper sheet S having the toner images passes through a fixing device 10, and the paper sheet S on which the toner images have been fixed is ejected through a paper ejection port 121 onto an ejected-paper tray 122 provided in an upper section of the image forming apparatus 100.

The image forming apparatus 100 has a controller 124. The controller 124 controls image forming operation and sheet conveying operation that have been described above and performs temperature control for the fixing device 10 that will be described later. Into the controller 124 are inputted a temperature in the apparatus that is detected by a temperature sensor St and a relative humidity that is detected by a humidity sensor Sh.

An operation panel 126 is provided in the upper section of the image forming apparatus 100. If a user selects a paper sheet S (such as thin paper) other than regular paper as a type of paper sheet S, on the operation panel 126, the type is inputted into the controller 124.

Figure 2:
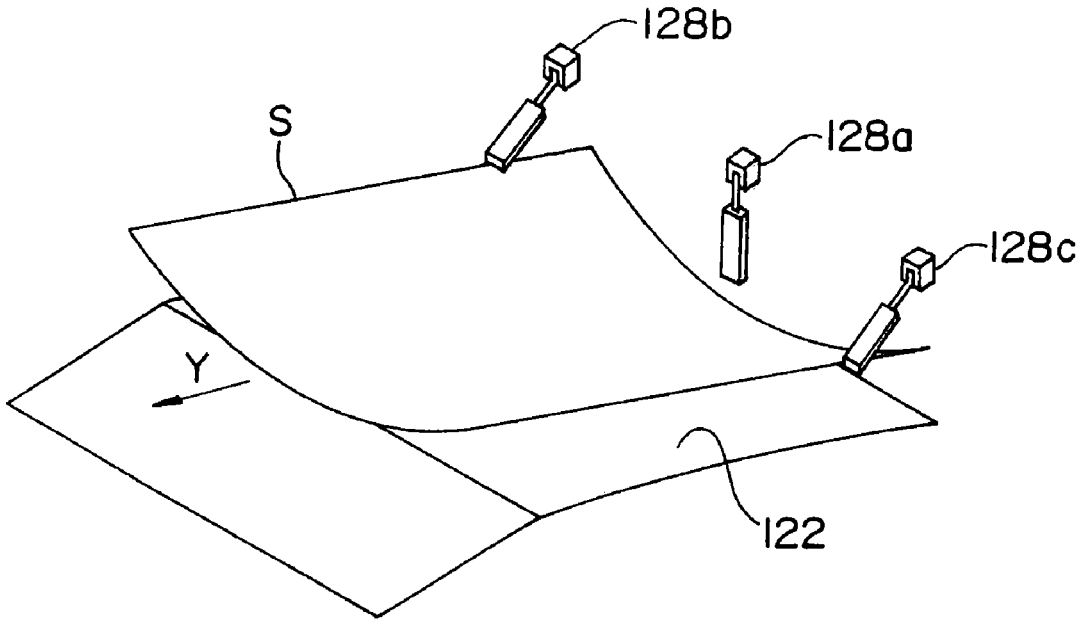
FIG. 2 is a perspective view showing a curl amount detection sensor.

On outside of the paper ejection port 121 of the image forming apparatus 100 may be provided a curl amount detection sensor 128. As shown in FIG. 2, the curl amount detection sensor 128 is composed of a center curl sensor 128*a* for detecting an amount of curl in center of a paper sheet S stored on the ejected-paper tray 122 with respect to a direction orthogonal to a paper ejection direction (a direction of an arrow Y) and of end curl sensors 128*b* and 128*c* for detecting amounts of curl at both ends of the paper sheet with respect to the direction orthogonal to the paper ejection direction. Results of detection by the curl sensors 128*a*, 128*b*, and 128*c* are inputted into the controller 124.

Figure 3:
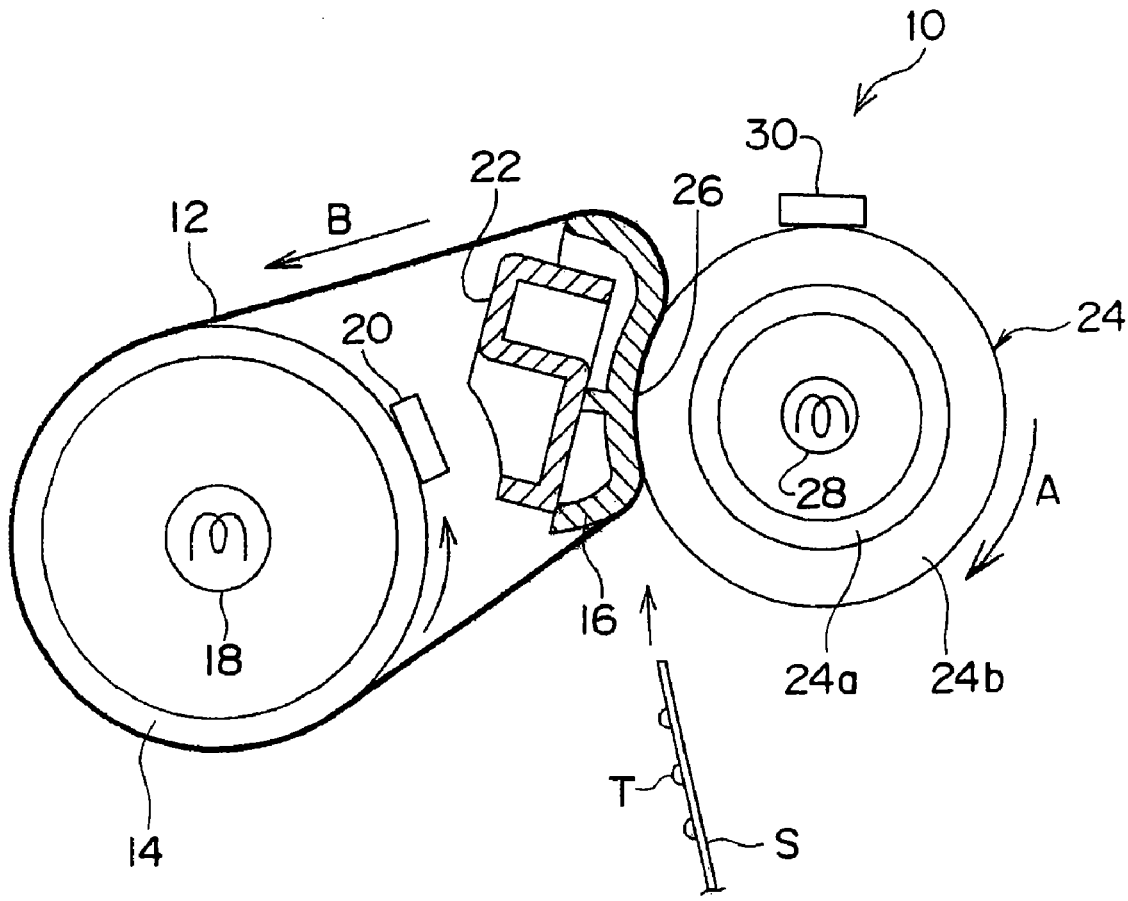
FIG. 3 is a side view, partly in section, of a fixing device.

Hereinbelow, the fixing device 10 will be described in detail with reference to FIG. 3.

The belt fixing device 10 has an endless-film-like fixing belt (a heating rotator) 12. In the fixing belt 12 that has an outside diameter of 50 mm and a width of about 240 mm in a longitudinal direction (a direction of depth in FIG. 3, the same as follows) when the belt is in form of a cylinder, for example, a 70-μm-thick base material composed of polyimide (PI), a 200-μm-thick elastic layer composed of silicone rubber, and a 30-μm-thick mold release layer composed of copolymer of tetrafluoroethylene and perfluoroalkyl vinylether (PFA) have been superimposed in order of mention from inside.

The fixing belt 12 is wound around a heating roller 14 that is rotatably provided and around a nip forming member 16 that is fixed in a position away from and parallel to the heating roller 14 in the fixing belt 12 so that the member 16 cannot be rotated. The heating roller 14 is composed of a cylinder made of aluminum and having an outside diameter of 30 mm, for example, and contains a heater (a first heat source) 18 composed of a 700 W halogen lamp, for example. The heater 18 is subjected to on-off control by the controller 124, so that temperatures of the heating roller 14 and the fixing belt 12 can be controlled. A temperature sensor 20 composed of a thermistor, for example, for detecting a temperature of an outer circumferential surface of the heating roller 14 is provided so as to be in contact with or adjacent to the heating roller 14, and the temperature detected by the temperature sensor 20 is inputted into the controller 124.

A rotatable roller may be substituted for the nip forming member 16.

The nip forming member 16 is composed of a main body composed of heat-resistant resin, for example, on which an elastic layer composed of silicone rubber, for example, is provided, and the member 16 extends in the longitudinal direction with a length not less than the width of the fixing belt 12. A surface of the elastic layer of the nip forming member 16 that is in contact with an inside surface of the fixing belt 12 is covered with a low-friction layer composed of material having a low coefficient of friction (such as PFA and PTFE (polytetrafluoroethylene)).

The nip forming member 16 is reinforced by a reinforcing member 22, e.g., composed of an SUS bar and is thereby prevented from being flexed in directions orthogonal to the longitudinal direction. Between the main body of the nip forming member 16 and the reinforcing member 22 is ensured a space intended for heat insulation.

A pressurizing roller (a pressurizing rotator) 24 is in pressure contact with the nip forming member 16, with the fixing belt 12 interposed between. Thus contact part between the fixing belt 12 and the pressurizing roller 24 forms a fixing nip 26. A paper sheet S having a toner image T formed on a surface thereof is introduced from lower side in the drawing into the fixing nip 26.

The pressurizing roller 24 is shaped like a circular cylinder having an outside diameter of about 30 mm, for example. In the roller 24, a circumference of a metal core 24*a* composed of a cylinder having an outside diameter of 22 mm and made of iron is covered with a 4-mm-thick elastic layer 24*b*, and a 40-μm-thick mold release layer is formed on a surface of the elastic layer 24*b*. The pressurizing roller 24 contains a heater (a second heat source) 28 composed of a 300 W halogen lamp, for example. The heater 28 is subjected to on-off control by the controller 124, so that a temperature of the pressurizing roller 24 can be controlled. A temperature sensor 30 composed of a thermistor, for example, for detecting a temperature of an outer circumferential surface of the pressurizing roller 24 is provided so as to be in contact with or adjacent to the pressurizing roller 24, and the temperature detected by the temperature sensor 30 is inputted into the controller 124.

Hereinbelow, operation of and control over the fixing device 10 will be described.

In the fixing device 10, the pressurizing roller 24 is driven by a motor not shown so as to rotate in a direction of an arrow A and the fixing belt 12 is thereby rotated in a direction of an arrow B while being slid on the nip forming member 16. While the fixing belt 12 is rotated in such a manner, an overall circumference of the fixing belt 12 is heated to a specified fixation temperature (e.g., 175° C.) through medium of the heating roller 14 heated, e.g., to about 190° C. by the heater 18. At this time, the pressurizing roller 24 has been heated to about 120° C., for example, by the heater 28.

After the fixing belt 12 is heated so as to have the specified fixation temperature, a paper sheet S having an unfixed toner image T formed on a surface thereof is introduced into the fixing nip 26. The toner image T is heated to be fused and is fixed onto the paper sheet S while the paper sheet S is passed through the fixing nip 26. After that, the paper sheet S is ejected through the paper ejection port 121 onto the ejected-paper tray 122.

By influence of the heat for the fixation, curl is given to the paper sheet S having been passed through the fixing nip 26. An increase in amount of the curl deteriorates condition of stacking when a large number of paper sheets S are stacked and stored on the ejected-paper tray 122, and thus may make it impossible to store a number of paper sheets S that can be stacked and stored on condition that the amount of the curl is small.

It has been found that amounts of the curl of paper sheets S having been passed through the fixing device 10 change according to environmental conditions. Table 1 below shows relations between temperatures of the pressurizing roller 24 and sheet stacking ability on the ejected-paper tray 122 which relations were examined under different environmental conditions with use of thin paper, as the paper sheets S, more prone to be curled than regular paper. In Table 1, "LL" denotes a condition of low temperature and low humidity with an environmental temperature not higher than 15° C., "HH" denotes a condition of high temperature and high humidity with an environmental temperature not lower than 32° C. or an absolute humidity not lower than 20 g/m$^3$, the absolute humidity calculated from the environmental temperature and a relative humidity, and "NN" denotes normal conditions other than the above. An expression "Stacking ability x" in Table 1 refers to a state in which an increase in the amount of the curl has deteriorated the stacking ability to such an extent that a specified allowable number of paper sheets S cannot be stacked and stored in the ejected-paper tray 122. When the temperature of the pressurizing roller was 120° C., there was no problem in the stacking ability under the normal conditions but the stacking ability was deteriorated under the condition of high temperature and high humidity, as shown in Table 1.

TABLE 1

| Pressurizing roller temperature | Stacking ability | | |
|---|---|---|---|
| (° C.) | LL | NN | HH |
| 80 | ○ | x | x |
| 90 | ○ | ○ | x |
| 100 | ○ | ○ | x |
| 110 | ○ | ○ | x |
| 120 | ○ | ○ | x |
| 130 | ○ | ○ | ○ |
| 140 | ○ | ○ | ○ |

Table 2 below shows relations between temperatures of the pressurizing roller and the sheet stacking ability which relations were examined under the condition of high temperature and high humidity with regard to regular paper and thin paper. A criterion for judgment of "Stacking ability x" in Table 2 is the same as that in Table 1. When the temperature of the pressurizing roller was 120° C., as shown in Table 2, there was no problem in the stacking ability for regular paper but the stacking ability for thin paper was deteriorated.

TABLE 2

| Pressurizing roller | Stacking ability | |
|---|---|---|
| temperature (° C.) | Regular paper | Thin paper |
| 80 | x | x |
| 90 | x | x |
| 100 | x | x |
| 110 | x | x |

TABLE 2-continued

| Pressurizing roller temperature (° C.) | Stacking ability: Regular paper | Stacking ability: Thin paper |
|---|---|---|
| 120 | ○ | x |
| 130 | ○ | ○ |
| 140 | ○ | ○ |

Furthermore, it has been found that an amount of the curl of a paper sheet S is reduced by decrease in temperature difference between the pressurizing roller 24 and the fixing belt 12 that is on heating side. In the image forming apparatus 100 of the embodiment, therefore, such control as follows is carried out over the fixing device 10.

When the temperature detected by the temperature sensor St becomes 32° C. or higher, for example, or when the absolute humidity calculated from the temperature detected by the temperature sensor St and from the relative humidity detected by the humidity sensor Sh becomes 20 g/m$^3$ or higher, for example, the controller 124 judges that the condition is of high temperature and high humidity and then controls activation of the heater 28 so that the temperature of the pressurizing roller 24 is set at a temperature, e.g., of 130° C. higher than the normal temperature of 120° C. Thus the amounts of the curl of paper sheets S can be reduced by decrease in temperature difference between the fixing belt 12 and the pressurizing roller 24 while the image fixation performance is maintained. As a result, deterioration in the sheet stacking ability on the ejected-paper tray 122 can be reduced.

In this process, the controller 124 doubles as a calculator for calculating the absolute humidity from the temperature detected by the temperature sensor St and from the relative humidity detected by the humidity sensor Sh. In the embodiment, the controller 124 judges the environmental condition on basis of the absolute humidity. The environmental condition, however, may be judged on basis of the relative humidity.

Though the control for increasing the temperature of the pressurizing roller 24 is carried out upon the judgment of the condition of high temperature and high humidity in the above, control for decreasing the temperature of the fixing belt 12 (i.e., the temperature of the heating roller 14) may simultaneously be carried out. The increase in the temperature of the pressurizing roller 24 causes increase in amount of heat that is supplied to the paper sheets S in the fixing nip 26, and therefore the decrease in the temperature of the fixing belt 12 to a certain extent exerts no influence upon the image fixation performance. Specifically, an image fixation performance is ensured under the normal condition with the temperature of the pressurizing roller of 120° C. and the temperature of the heating roller of 190° C. Provided that the temperature of the pressurizing roller 24 is increased to be not lower than 130° C. under the condition of high temperature and high humidity, the temperature of the heating roller 14 can be decreased as shown in Table 3 below while the image fixation performance is maintained. With this control, the temperature difference between the fixing belt 12 and the pressurizing roller 24 is further decreased, and therefore an effect of reducing the deterioration in the sheet stacking ability becomes more remarkable.

TABLE 3

| Pressurizing roller temperature (° C.) | Heating roller temperature (° C.) |
|---|---|
| 120 | 190 |
| 130 | 185 |
| 140 | 180 |
| 150 | 175 |

The controller 124 controls the image forming operation and the sheet conveying operation and is therefore capable of adjusting intervals between paper sheets S by changing temporal intervals of drive of the paper feeding roller 118. Thus control for increasing intervals between paper sheets S that are continually fed through the fixing nip 26 may be carried out simultaneously with the control for increasing the temperature of the pressurizing roller 24 or the control for decreasing the temperature of the heating roller 14 while increasing the temperature of the pressurizing roller 24 that have been described above. As a matter of course, timing of the image forming operation is adjusted in conformity with the increase in the intervals between the paper sheets.

Figure 4:
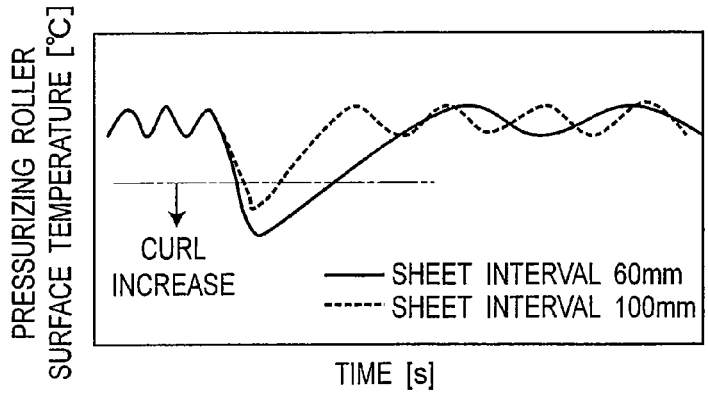
FIG. 4 is a graph showing relations between time and temperatures of a pressurizing roller, with sheet intervals changed.

Provided that intervals between paper sheets that are continually fed under the normal condition are 60 mm, for example, specifically, intervals between paper sheets under the condition of high temperature and high humidity are set at 100 mm, for example. With such increase in the intervals between the paper sheets, an amount of heat taken from the pressurizing roller 24 into the paper sheets S is decreased and a length of time during which the fixing belt 12 is in contact with the pressurizing roller 24 is increased so that an amount of heat transferred from the fixing belt 12 to the pressurizing roller 24 is increased, in comparison with the operation with the normal sheet intervals. Accordingly, recovery of surface temperature of the pressurizing roller 24 on occasion of the continual sheet feeding is quickened as shown in FIG. 4. Thus a number of paper sheets having large amounts of curl can be decreased because a length of time during which the temperature of the pressurizing roller 24 is so low as to increase an amount of curl of a paper sheet is decreased in comparison with that in the operation with the normal sheet intervals and because the increase in the sheet intervals causes decrease in a number of sheets that are fed per unit time. As a result, the effect of reducing the deterioration in the sheet stacking ability becomes further remarkable.

Figure 5:
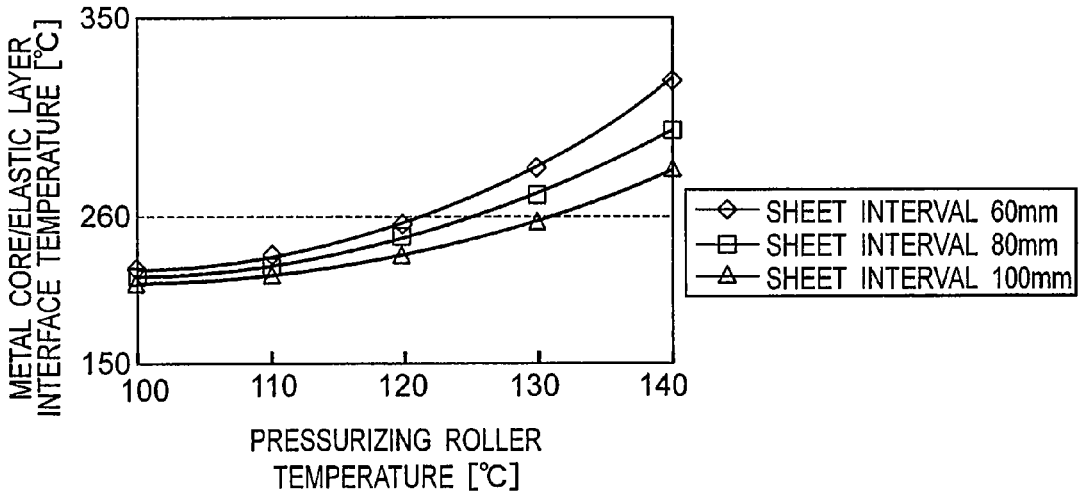
FIG. 5 is a graph showing relations between temperatures of the pressurizing roller and border temperatures in the pressurizing roller, with sheet intervals changed.

The increase in the sheet intervals quickens the recovery of the temperature of the pressurizing roller 24 on occasion of the continual sheet feeding, and therefore allows the controller 124 to turn off the heater 28 with timing earlier than in the operation with the normal sheet intervals, in the on-off control over the heater 28 for maintaining the temperature of the pressurizing roller 24 at a preset temperature, when the controller 124 receives signal from the temperature sensor 30 that has detected the recovery of the temperature. Accordingly, a length of time for heating by the heater 28 is decreased, and thus a temperature on border between the metal core 24*a* and the elastic layer 24*b* in the pressurizing roller 24 can be restrained from increasing. This is shown in a graph of FIG. 5. As shown in FIG. 5, the border temperature is 260° C. on condition that the preset temperature of the pressurizing roller 24 is 120° C. and that the sheet intervals are 60 mm. On condition that the preset temperature of the pressurizing roller 24 is 130° C., the border temperature can be maintained at 260° C. by increase in the sheet intervals to 100 mm. Such restraint of the increase in the border temperature has an effect of preventing breaks in an adhesive layer between the metal core 24*a* and the elastic layer 24*b* in the pressurizing roller 24.

Though the control for restraining the amounts of curl of paper sheets is carried out in the above when the temperature or the humidity is larger than each specified value, the control may be carried out on basis of only one of the temperature and the humidity.

The control for increasing the sheet intervals may solely be carried out without change in the preset temperature of the pressurizing roller when the temperature or the absolute humidity is larger than each specified value. Also in this case, a number of paper sheets having large amounts of curl can be reduced for a reason described above and the deterioration in the sheet stacking ability can be relieved.

In the above, the control for increasing the temperature of the pressurizing roller 24, the control for decreasing the temperature of the heating roller 14 while increasing the temperature of the pressurizing roller 24, and the control for increasing the sheet intervals are carried out when the temperature or the absolute humidity is larger than each specified value. Those control operations, however, may be carried out when a basis weight of a paper sheet S passing through the fixing nip 26 is smaller than that of regular paper. When thin paper that has a basis weight (not larger than 60 g/m$^2$) smaller than thick paper (not smaller than 101 g/m$^2$) and regular paper (61 through 100 g/m$^2$) have been selected as paper sheet S on the operation panel 126 by a user, specifically, the controller 124 may carry out control for increasing the preset temperature of the pressurizing roller 24 from 120° C. to 130° C. with respect to a temperature of the heating roller 14 of 190° C. or control for decreasing the preset temperature of the heating roller 14 from 190° C. to 185° C. while increasing the temperature of the pressurizing roller 24 from 120° C. to 130° C. and may simultaneously carry out control for increasing the sheet intervals from 60 mm to 100 mm. For thin paper more prone to be curled than regular paper, in this manner, amounts of curl of paper sheets S can be restrained and the deterioration in the sheet stacking ability on the ejected-paper tray 122 can be relieved.

Provided that the image forming apparatus 100 has the curl amount detection sensor 128 that is capable of detecting an amount of curl of a paper sheet S on the ejected-paper tray 122, the controller 124 may carry out the control for increasing the temperature of the pressurizing roller 24, the control for decreasing the temperature of the heating roller 14 while increasing the temperature of the pressurizing roller 24, and the control for increasing the sheet intervals, as described above, not on basis of temperature, humidity, and type of paper sheet but when an amount of curl of a paper sheet S detected by the curl amount detection sensor 128 is larger than a specified value. Specific details of the control in this case are the same as those in the above case that paper sheet S is thin paper. By such control in which an amount of curl of a paper sheet S is directly detected and in which the temperature of the pressurizing roller 24 is increased or the like, amounts of curl of paper sheets S can be restrained and the deterioration in the sheet stacking ability on the ejected-paper tray 122 can be relieved.

Figure 6A:
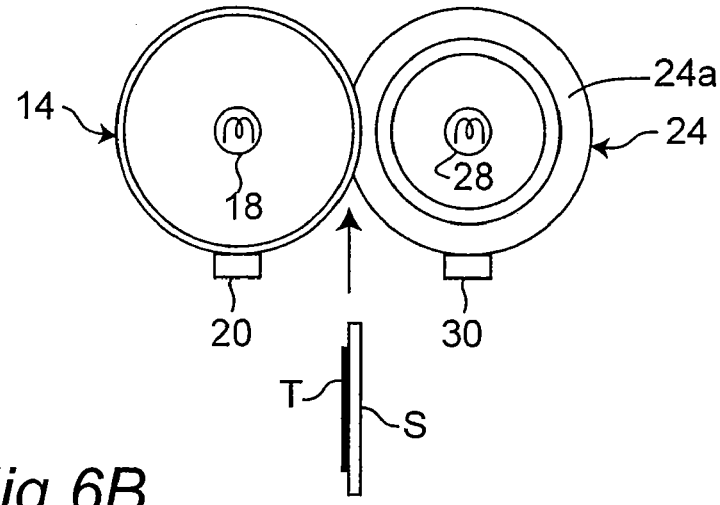
FIGS. 6A, 6B, 6C are diagrams showing fixing devices of roller pair type.
Figure 6B:
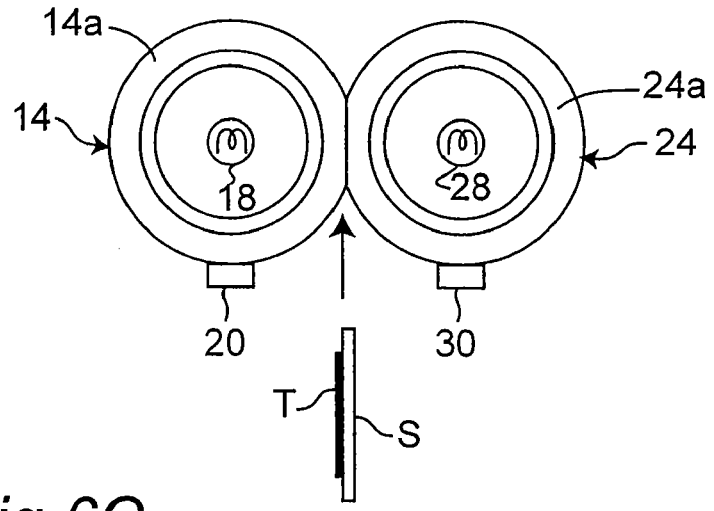
Figure 6C:
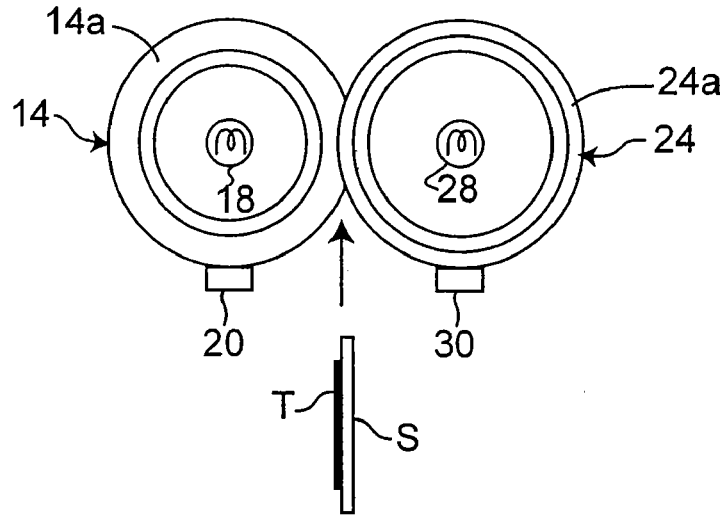

The control operations described above may be applied not only to belt-type fixing devices but also to a fixing device of roller pair type composed of a heating roller 14 and a pressurizing roller 24 that are in pressure contact with each other as shown in FIGS. 6A, 6B and 6C. In such a fixing device of roller pair type, the heating roller 14 serves as a heating rotator. FIG. 6A shows a fixing device in which only the pressurizing roller 24 has an elastic layer 24*a*, FIG. 6B shows a fixing device in which the heating roller 14 and the pressurizing roller 24 have elastic layers 14*a* and 24*a*, respectively, that deform in generally the same fashion, and FIG. 6C shows a fixing device in which an amount of deformation of an elastic layer 14*a* of the heating roller 14 is larger than that of an elastic layer 24*a* of the pressurizing roller 24.

As a matter of course, the invention may be applied not only to full color image forming apparatus but also to monochromatic image forming apparatus.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a humidity sensor that detects a humidity in the apparatus; and a controller that increases intervals between paper sheets being continually fed to the fixing nip so that the intervals are larger than a normal value under a condition that the humidity obtained on basis of output from the humidity sensor exceeds a specified value.

2. The image forming apparatus as claimed in claim 1, wherein the controller is configured to carry out control for increasing a temperature of the pressurizing rotator under the condition that the humidity obtained on the basis of the output from the humidity sensor exceeds the specified value.

3. The image forming apparatus as claimed in claim 1, wherein the controller is configured to carry out control for decreasing a temperature of the heating rotator simultaneously when increasing a temperature of the pressurizing rotator under the condition that the humidity obtained on the basis of the output from the humidity sensor exceeds the specified value.

4. The image forming apparatus as claimed in claim 1, further comprising:

a nip forming member spaced apart from the heating rotator; and a fixing belt that is wound around the heating roller and the nip forming member, wherein the pressurizing rotator is in pressure contact with the nip foaming member to form the fixing nip.

5. The image forming apparatus as claimed in claim 1, wherein the controller is configured to set a temperature of the pressurizing rotator based at least on type of paper sheet used, environmental temperature, and environmental humidity.

6. The image forming apparatus as claimed in claim 1, wherein the controller is configured to normally keep a temperature of the heating rotator higher than a temperature of the pressuring rotator.

7. The image forming apparatus as claimed in claim 1, wherein the controller is configured to set a temperature of the pressurizing rotator higher than a temperature used for a regular paper when a basis weight of a paper sheet passing through the fixing nip is smaller than a specified value.

8. An image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a humidity sensor that detects a humidity in the apparatus;

a curl amount detection sensor configured to detect an amount of paper curl; and a controller that is configured to increase intervals between paper sheets being continually fed to the fixing nip so that the intervals are larger than a normal value under a condition that the humidity obtained on basis of output from the humidity sensor exceeds a specified value, and that is configured to increase a temperature of the pressurizing roller and to decrease a temperature of the heating roller under a condition that the amount of paper curl detected by the curl amount detection unit exceeds a specified value.

9. A image forming apparatus, comprising:

a heating rotator that is heated by a first heat source;

a pressurizing rotator that is heated by a second heat source, that is in pressure contact with the heating rotator, and that forms a fixing nip between the pressurizing rotator and the heating rotator;

a humidity sensor that detects a humidity in the apparatus; and a controller that is configured to increase intervals between paper sheets being continually fed to the fixing nip so that the intervals are larger than a normal value under a condition that the humidity obtained on basis of output from the humidity sensor exceeds a specified value, and that is configured to increase a temperature of the pressurizing roller and to decrease a temperature of the heating roller under a condition that the humidity obtained on the basis of the output from the humidity sensor exceeds the specified value.

* * * * *